US011131264B2

(12) United States Patent
Watanabe et al.

(10) Patent No.: US 11,131,264 B2
(45) Date of Patent: Sep. 28, 2021

(54) FUEL INJECTION CONTROL DEVICE

(71) Applicant: DENSO CORPORATION, Kariya (JP)

(72) Inventors: Masahiro Watanabe, Kariya (JP); Daiji Ueda, Kariya (JP); Hiroki Tanada, Kariya (JP)

(73) Assignee: DENSO CORPORATION, Kariya (JP)

( * ) Notice: Subject to any disclaimer, the term of this patent is extended or adjusted under 35 U.S.C. 154(b) by 574 days.

(21) Appl. No.: 16/101,688

(22) Filed: Aug. 13, 2018

(65) Prior Publication Data

US 2019/0063358 A1 Feb. 28, 2019

(30) Foreign Application Priority Data

Aug. 23, 2017 (JP) ..... JP2017-160363

(51) Int. Cl.

| | |
|---|---|
| ***F02D 41/00*** | (2006.01) |
| ***F02D 41/20*** | (2006.01) |
| ***F02M 51/06*** | (2006.01) |
| ***F02M 47/02*** | (2006.01) |

(52) U.S. Cl.

CPC ..... *F02D 41/2096* (2013.01); *F02M 47/027* (2013.01); *F02M 51/0603* (2013.01); *F02D 2041/2003* (2013.01); *F02D 2041/2024* (2013.01); *F02D 2041/2051* (2013.01)

(58) Field of Classification Search

CPC ..... F02D 41/2096; F02D 2041/2003; F02D 2041/2024; F02D 2041/2051; F02M 51/0603; F02M 47/027

See application file for complete search history.

(56) References Cited

U.S. PATENT DOCUMENTS

| | | | | |
|---|---|---|---|---|
| 6,253,736 | B1 * | 7/2001 | Crofts | F02M 47/027 123/467 |
| 2001/0023686 | A1 * | 9/2001 | Okamoto | F02D 41/20 123/490 |
| 2002/0041475 | A1 * | 4/2002 | Rueger | G01R 31/2829 361/91.1 |
| 2002/0046731 | A1 * | 4/2002 | Rueger | F02D 41/2096 123/299 |
| 2002/0117939 | A1 | 8/2002 | Kawamoto | |

(Continued)

FOREIGN PATENT DOCUMENTS

| | | |
|---|---|---|
| DE | 101 50 414 | 11/2009 |
| JP | 2002-161824 | 6/2002 |
| JP | 2009-197600 | 9/2009 |

*Primary Examiner* — Phutthiwat Wongwian
*Assistant Examiner* — Sherman D Manley
(74) *Attorney, Agent, or Firm* — Nixon & Vanderhye P.C.

(57) ABSTRACT

A fuel injection control device has a valve opening control portion which opens a control valve by electrically charging a piezoelectric element, and a valve closing portion which closes the control valve. The valve opening control portion includes a first rising control portion, a pause control portion and a second control portion. The first rising control portion increases a charge amount of the piezoelectric element during a first rising period. The pause control portion pauses an increase in the charge amount of the piezoelectric element during a pause period after the first rising period. The second rising control portion increases the charging amount of the piezoelectric elements again during a second rising period after the pause period. The pause period includes a period of immediately before the control valve is opened.

6 Claims, 6 Drawing Sheets

(56) References Cited

U.S. PATENT DOCUMENTS

| | | | | |
|---|---|---|---|---|
| 2003/0106533 | A1* | 6/2003 | Crofts | F02M 65/005 123/446 |
| 2005/0022793 | A1 | 2/2005 | Takemoto | |
| 2006/0231311 | A1 | 10/2006 | Fujii et al. | |
| 2008/0047529 | A1 | 2/2008 | Cooke et al. | |
| 2009/0179088 | A1 | 7/2009 | Mochizuki et al. | |
| 2010/0063709 | A1* | 3/2010 | Ascher | F02D 41/2096 701/103 |
| 2010/0096473 | A1* | 4/2010 | Coldren | F02M 63/0029 239/90 |
| 2013/0167808 | A1* | 7/2013 | Stucchi | F02M 69/04 123/478 |
| 2015/0096539 | A1* | 4/2015 | Leblon | H01L 41/042 123/478 |
| 2015/0369187 | A1* | 12/2015 | Leblon | F02M 51/0603 239/5 |
| 2016/0053704 | A1* | 2/2016 | Russe | F02D 41/2096 123/478 |
| 2016/0115896 | A1 | 4/2016 | Kanbara et al. | |
| 2016/0281624 | A1* | 9/2016 | Dames | F02D 41/40 |
| 2016/0356251 | A1* | 12/2016 | Kanbara | F02M 45/10 |

* cited by examiner

FUEL INJECTION CONTROL DEVICE

CROSS REFERENCE TO RELATED APPLICATION

This application is based on Japanese Patent Application No. 2017-160363 filed on Aug. 23, 2017, the disclosure of which is incorporated herein by reference.

TECHNICAL FIELD

The present disclosure relates to a fuel injection control device which controls a fuel injector having a piezoelectric element. The fuel injection control device controls charging and discharging of the piezoelectric element.

BACKGROUND

JP 2016-84748 A shows a fuel injector which has a valve body opening/closing an injection port, a control chamber, a control valve opening/closing a fuel passage, and a piezoelectric element opening the control valve. When the control valve opens the fuel passage, the fuel in the control chamber flows out. A fuel pressure in the control chamber is decreased, and the valve body opens the injection port.

It is desired to improve a valve-opening response of the valve. In order to improve the valve-opening response, a rising speed of the voltage applied to a piezoelectric element can be made higher. However, immediately after the control valve is opened, load missing is easily generated, which may cause a damage of the piezoelectric element.

Until the control valve is opened after the piezoelectric element is energized, a charging amount of the piezoelectric element increases while the piezoelectric element does not expand. An expanding force of the piezoelectric element is increased. When the expanding force of the piezoelectric element is increased enough, the control valve starts opening.

Immediately after the control valve is opened, a fuel pressure biasing the valve body in a valve-closing direction is rapidly decreased. Due to an inertial expansion of the piezoelectric element, a tensile force is generated in the piezoelectric element, which is referred to as load missing. Such load missing may cause a damage of piezoelectric element.

SUMMARY

It is an object of the present disclosure to provide a fuel injection control device which is capable of restricting a damage of a piezoelectric element due to a load missing and is capable of improving a valve-opening response.

According to the present disclosure, a fuel injection control device is applied to a fuel injector having a valve body opening/closing an injection port through which a fuel is injected; a control chamber for receiving the fuel which applies a valve-closing force to the valve body; a control valve controlling the valve-closing force by opening/closing an outlet passage through which the fuel flows out from the control chamber; and a piezoelectric element opening the control valve when being electrically charged to expand.

The fuel injection control device includes: a valve opening control portion opening the control valve by electrically charging the piezoelectric element; and a valve closing control portion closing the control valve by electrically discharging the piezoelectric element.

The valve opening control portion includes: a first rising control portion for increasing a charge amount of the piezoelectric element during a first rising period; a pause control portion for pausing an increase in the charge amount of the piezoelectric element during a pause period after the first rising period; and a second rising control portion for increasing the charge amount of the piezoelectric element after the pause period.

The pause period includes a period of immediately before the control valve is opened.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Referring to drawings, a plurality of embodiments will be described hereinafter.

First Embodiment

Figure 1:
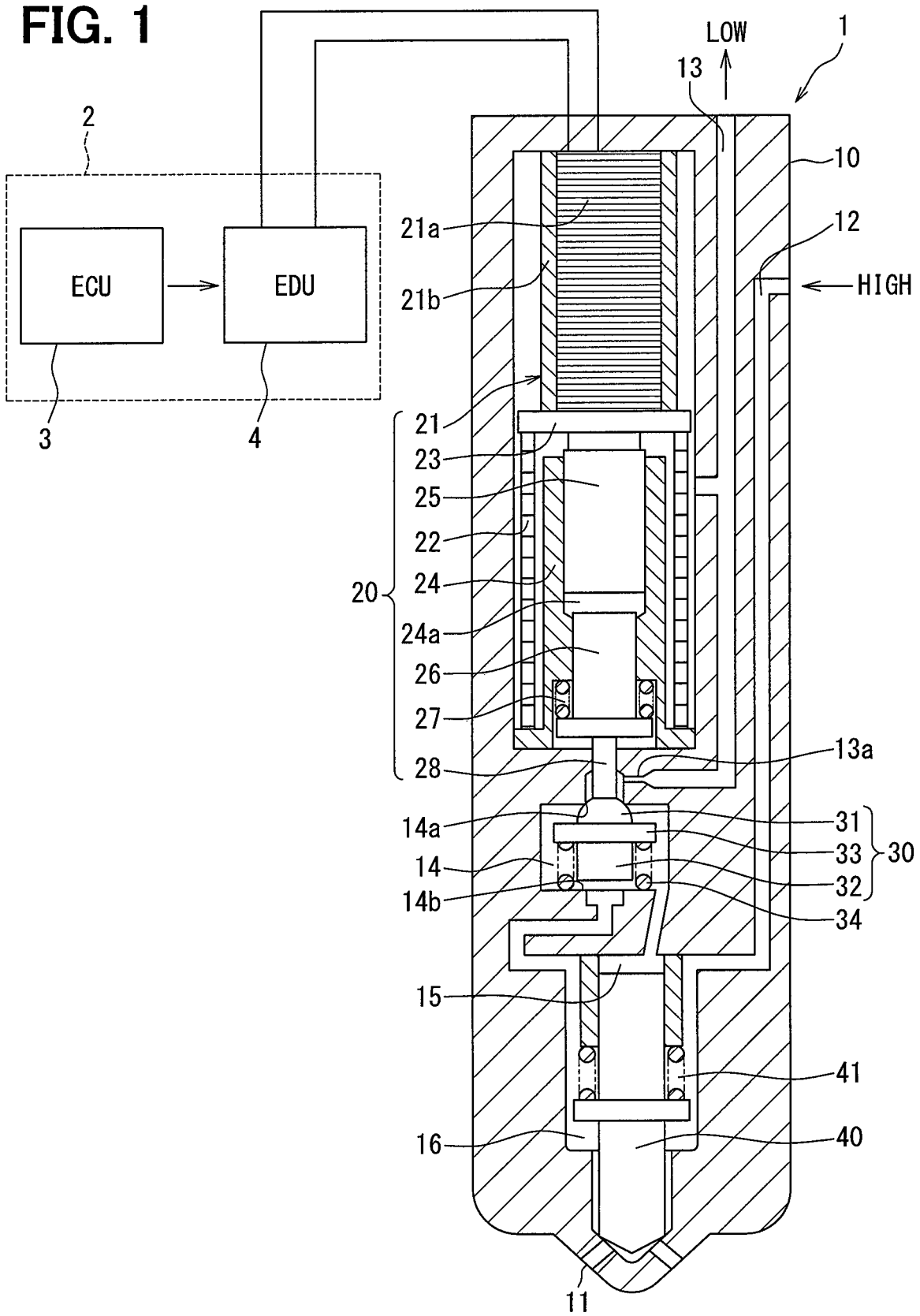
FIG. 1 is a schematic diagram showing a fuel injector and a fuel injection control device according to a first embodiment.

FIG. 1 shows a fuel injector 1 which is mounted on an internal combustion engine for a vehicle. The internal combustion engine is a diesel engine or a gasoline engine. A high-pressure fuel is accumulated in a common-rail (not shown) to be supplied to each fuel injector 1. The fuel injector 1 injects the fuel into a combustion chamber of the internal combustion engine.

A fuel injection control device, which will be referred to as a control device 2, controls an operation of the fuel injector 1. Specifically, the control device 2 controls a charging/discharging of the piezoelectric element 21*a* of the fuel injector 1 so as to control a fuel injection amount, a fuel injection timing and a number of fuel injection. Further, the control device 2 controls a high-pressure pump (not shown) so as to control the fuel pressure in the common-rail, which is referred to as a supplied fuel pressure.

The control device 2 is configured by a microcomputer which includes at least one central processing unit (CPU)

and at least one memory device which stores programs and data. The memory device is a non-transitional physical storage medium that temporarily stores computer-readable programs. The memory device is provided by a semiconductor memory, a magnetic disk, etc. The programs are executed by the control device 2.

An electronic control unit (ECU) 3 has an arithmetic circuit configured by a microcomputer or a microcontroller. The arithmetic circuit includes a processor, a RAM, and a rewritable nonvolatile memory device. An electronic driver unit (EDU) 4 applies a drive voltage to the piezoelectric element 21*a* according to command signals transmitted from the ECU 3.

The control device 2 is an electronic control unit including the ECU 3 and the EDU 4, which configures a fuel injection system along with the fuel injector 1. The ECU 3 transmits a command signal of low-voltage (for example, 5 V), and the EDU 4 transmits a drive voltage which is higher than the command signal.

The ECU 3 determines the injection amount, the injection timing and the number of fuel injection according to a rotation speed of a crankshaft and an engine load, and then transmits the command signal to the EDU 4. The EDU 4 supplies an electric power corresponding to the command signal to the piezoelectric element 21*a* at a timing corresponding to the command signal, and controls charge amount and discharge amount of the piezoelectric element 21*a*. That is, the control device 2 controls the charge/discharge amount to the piezoelectric element 21*a* and the charge/discharge timing of the piezoelectric element 21*a* according to a driving condition of the internal combustion engine.

More specifically, the EDU 4 includes a booster circuit, a charge switch, a discharge switch, and a conduction switch, which are not shown. The booster circuit boosts a battery voltage (for example, 14 V) into a high voltage (for example, 150 to 300 V). The conduction switch is for controlling an energization of the piezoelectric element 21*a*.

When both of the charge switch and the conduction switch are turned ON, a charge amount of the piezoelectric element 21*a* is increased. During a charging period, the charged switch is kept ON and the conduction switch is repeatedly turned ON/OFF, whereby the charge amount and a charge rate are controlled by the control device 2.

When both of the discharge switch and the conduction switch are turned ON, a discharge amount of the piezoelectric element 21*a* is increased. During a discharging period, the discharged switch is kept ON and the conduction switch is turned ON/OFF, whereby the discharge amount and a discharge rate are controlled by the control device 2.

The fuel injector 1 is provided to a cylinder head of the internal combustion engine and directly injects the high-pressure fuel into the combustion chamber of the internal combustion engine through the injection port 11. The fuel injector 1 utilizes a part of high-pressure fuel in order to open/close the injection port 11. A part of the fuel supplied to the fuel injector 1 is returned to a fuel tank (not shown).

The fuel injector 1 has a body 10, an actuator 20, a control valve 30 and a needle 40. The body 10 defines the injection port 11, a high-pressure passage 12, a low-pressure passage 13, a valve chamber 14, a backpressure chamber 15 and a nozzle chamber 16. The high-pressure fuel supplied from the common-rail flows through the high-pressure passage 12 and the nozzle chamber 16. Then, the high-pressure fuel is injected from the injection port 11 into a combustion chamber. A part of the high-pressure fuel supplied from the high-pressure passage 12 is used for opening and closing the injection port 11. The fuel discharged from the backpressure chamber 15 and the valve chamber 14 is returned to the fuel tank through the low-pressure passage 13.

Since the backpressure chamber 15 and the valve chamber 14 always communicate with each other, the fuel pressure in the backpressure chamber 15 and the fuel pressure in the valve chamber 14 are substantially equal if a time lag is ignored. The backpressure chamber 15 and the valve chamber 14 correspond to a control chamber. The fuel in the control chamber applies a valve-closing force to the needle 40. The low-pressure passage 13 corresponds to an outlet passage through which the fuel flows out from the control chamber.

The needle (valve body) 40 opens/closes the injection port 11. The needle 40 receives an elastic force of an elastic member 41 in a valve-closing direction. The fuel pressure in the backpressure chamber 15 is applied to a pressure-receiving end of the needle 40 in a valve-closing direction. The fuel pressure in the nozzle chamber 16 is applied to a tip end of the needle 40 in a valve-opening direction. Thus, when the fuel pressure in the backpressure chamber 15 is decreased more than a predetermined pressure, the needle 40 moves in a valve-opening direction so that the fuel is injected from the injection port 11. When the fuel pressure in the backpressure chamber 15 is increased more than or equal to the predetermined pressure, the needle moves in a valve-closing direction so that a fuel injection is terminated.

The control valve 30 is disposed in the valve chamber 14, and has a first valve 31, a second valve 32 and a flange portion 33. When the first valve 31 sits on a first valve seat 14*a* provided to the body 10, the valve chamber 14 and the low-pressure passage 13 are fluidly disconnected. When the first valve 31 moves away from the first valve seat 14*a*, the valve chamber 14 and the low-pressure passage 13 are fluidly connected. When the second valve 32 sits on a second valve seat 14*b* provided to the body 10, the valve chamber 14 and the nozzle chamber 16 are fluidly disconnected. When the second valve 32 moves away from the second valve seat 14*b*, the valve chamber 14 and the nozzle chamber 16 are fluidly connected. The first valve 31 has a spherical outer surface which is capable of sitting on the first valve seat 14*a*. The second valve 32 has a flat surface which is capable of sitting on the second valve seat 14*b*. When one of the first valve 31 and the second valve 32 sits on the seat surface, the other moves away from the seat surface.

An elastic member 34 biases the flange portion 33 in such a manner that the first valve 31 sits on the first valve seat 14*a*. The actuator 20 applies a driving force to the first valve 31 so that the first valve 31 moves away from the first valve seat 14*a*. When the first valve 31 sits on the first valve seat 14*a*, the fuel pressure in the valve chamber 14 is applied to the first valve 31 in a valve-closing direction. When the first valve 31 moves way from first valve seat 14*a* and the second valve 32 sits on the second valve seat 14*b*, the fuel pressure in the nozzle chamber 16 is applied to the first valve 31 in a valve-closing direction and to the second valve 32 in a valve-opening direction.

Figure 3:
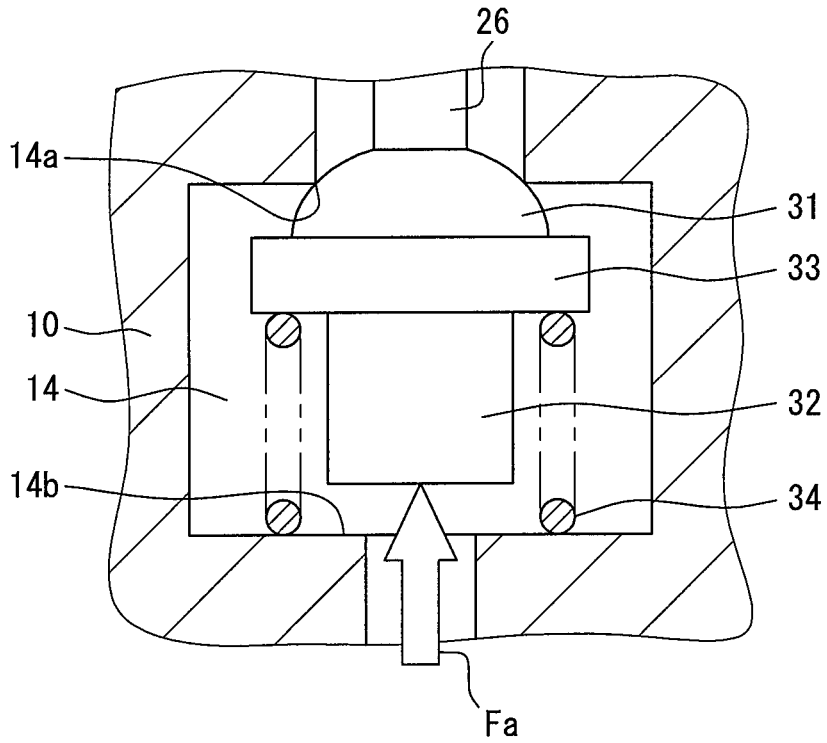
FIG. 3 is a sectional view showing a control valve which is closed.
Figure 4:
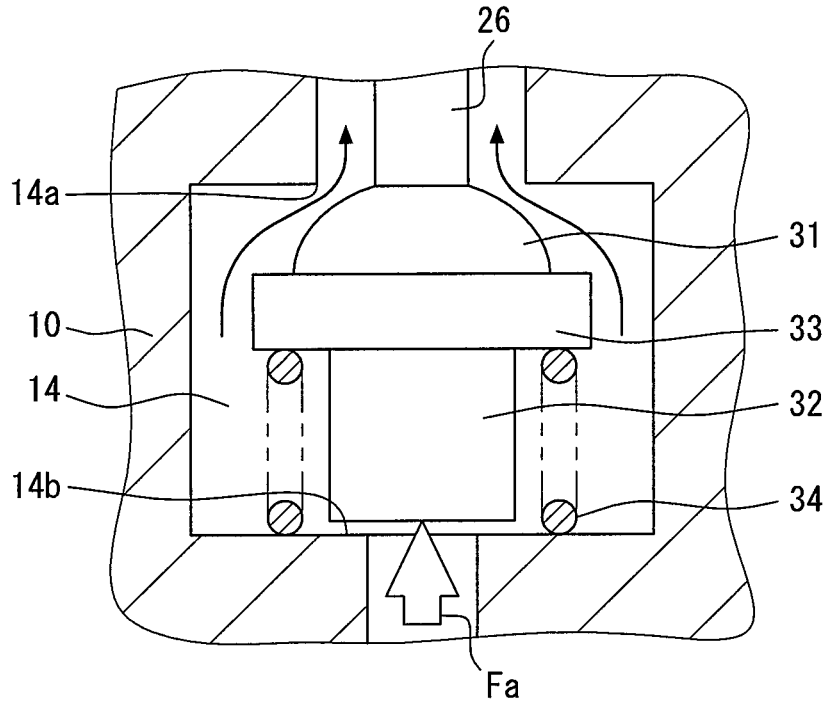
FIG. 4 is a sectional view showing a control valve which is opened.

FIG. 3 shows that the first valve 31 sits on the first valve seat 14*a*. In this condition, when a driving force of the actuator 20 becomes larger than a total of the biasing force of the elastic member 34 and a fuel force Fa (valve-closing force) in the valve chamber 14, the first valve 31 starts moving away from the first valve seat 14*a*. After the first valve 31 moves away from the first valve seat 14*a*, the fuel pressure in the valve chamber 14 is decreased and the fuel force Fa becomes smaller, as shown in FIG. 4.

After the first valve 31 is closed, when the actuator 20 pushes down the control valve 30, the second valve 32 sits on the second valve seat 14*b*. That is, the second valve 32 shifts from a valve-opening condition to a valve-closing condition. In order to keep the valve-closing condition, it is necessary that a driving force of the actuator 20 is larger than a total force of the biasing force of the elastic member 34 and the fuel force in the nozzle chamber 16.

The actuator 20 has a piezo stack 21, an elastic member 22, an abutment plate 23, a guide member 24, a large-diameter piston 25, a small-diameter piston 26, a spring 27 and a rod 28. The piezo stack 21 includes a plurality of piezoelectric elements 21*a* and a holding member 21*b* which holds the piezoelectric elements 21*a*. One piezoelectric element 21*a* has a plate shape, and a plurality of piezoelectric elements 21*a* are arranged in a direction perpendicular to a plate surface. In addition, the piezoelectric elements 21*a* are electrically connected in series.

The piezoelectric elements 21*a* functions as an actuator by expanding and contracting due to an inverse piezoelectric effect. Specifically, each of the piezoelectric elements 21*a* is a capacitive load that expands when electrically charged, and contracts when electrically discharged.

The elastic member 22 is elastically deformed in an axial direction so as to apply a compression preload Fpre (refer to FIG. 8) to the abutment plate 23. The abutment plate 23 is in contact with the piezo stack 21 to transfer the compression preload Fpre to the piezo stack 21. The piezo stack 21 is sandwiched between an inner wall of the body 10 and the abutment plate 23 while receiving a compressive force from the abutment plate 23. That is, regardless of whether or not the piezoelectric element 21*a* is energized, the compression preload Fpre is applied to the piezoelectric elements 21*a*.

The guide member 24 holds the large-diameter piston 25 and the small-diameter piston 26 in such a manner that the pistons 25, 26 are able to slide in the guide member 24. An inner wall surface of the guide member 24, a lower end surface of the large-diameter piston 25 and an upper end surface of the small-diameter piston 26 define an oil-tight chamber 24*a*. The oil-tight chamber 24*a* is filled with the fuel.

The spring 27 applies an elastic force to the small-diameter piston 26. The small-diameter piston 26 is biased toward the first valve 31 by the elastic force of the spring 27 and the fuel force in the oil-tight chamber 24*a*. Thereby, the first valve 31 moves away from the first valve seat 14*a*. That is, the first valve 31 receives a valve-opening force.

An operation of the fuel injector 1 will be described hereinafter.

When the piezoelectric element 21*a* is energized to expand, the large-diameter piston 25 moves toward the small-diameter piston 26. A movement of the large-diameter piston 25 is transmitted to the small-diameter piston 26 through the oil-tight chamber 24*a*, and the small-diameter piston 26 moves toward the control valve 30. The control valve 30 is pushed down so that the first valve 31 moves away from the first valve seat 14*a*.

The fuel in the valve chamber 14 is discharged through the orifice 13*a* and the low-pressure passage 13, so that the fuel pressure in the valve chamber 14 is decreased. Since the valve chamber 14 communicates with the backpressure chamber 15, the fuel pressure in the backpressure chamber 15 is also decreased. The needle 40 stats moving up.

Immediately after the first valve 31 is opened, the second valve 32 is still closed. After the first valve 31 is opened, the piezoelectric elements 21*a* are expanded so that the second valve 32 sits on the second valve seat 14*b*. That is, the second valve 32 is closed. The nozzle chamber 16 and the valve chamber 14 are fluidly disconnected from each other. As a result, the fuel pressure in the valve chamber 14 and the backpressure chamber 15 is decreased, and the needle 40 starts moving up. That is, it is expedited to reduce a time period in which the needle 40 is opened after the piezoelectric element 21*a* starts to be energized. A valve-opening responsiveness of the needle 40 is improved.

When the piezoelectric element 21*a* is deenergized to contract, the large-diameter piston 25 and the small-diameter piston 26 move apart from the valve chamber 14. The control valve 30 moves closer to the actuator 20 by the elastic force of the elastic member 34. As a result, the second valve 32 moves apart from the second valve seat 14*b*, and the first valve 31 sits on the first valve seat 14*a*.

The nozzle chamber 16 and the valve chamber 14 are fluidly connected with each other, and the valve chamber 14 and the low-pressure passage 13 are fluidly disconnected with each other. The fuel stops flowing into the low-pressure passage 13 from the valve chamber 14. The fuel flows into the valve chamber 14 from the nozzle chamber 16, so that the fuel pressure in the valve chamber 14 increases. Since the valve chamber 14 communicates with the backpressure chamber 15, the fuel pressure in the backpressure chamber 15 also increases. The backpressure of the needle 40 increases, so that the needle 40 starts moving down to close the injection port 11.

Figure 2:
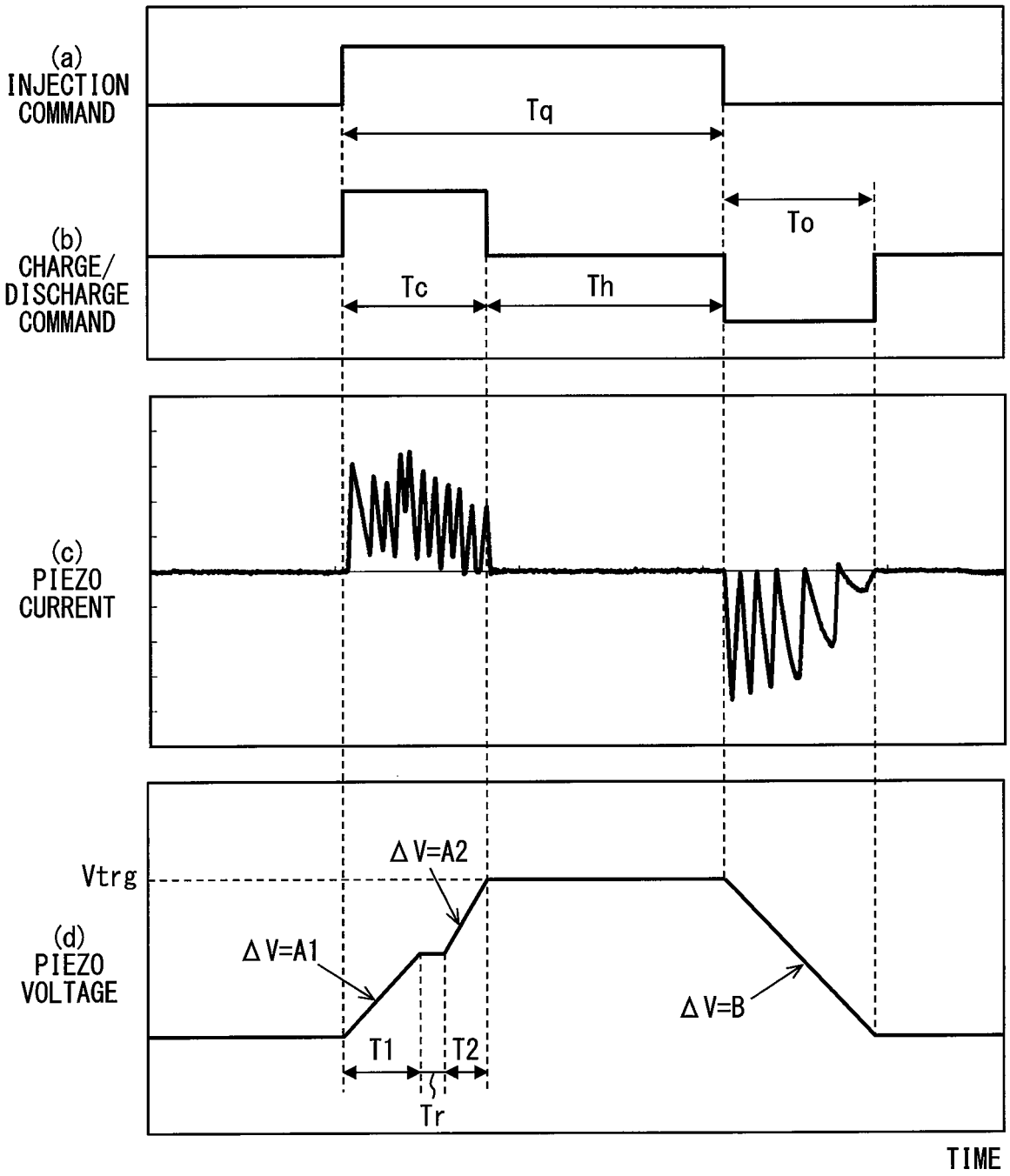
FIG. 2 is a diagram showing temporal changes in charging current and charging voltage during a charging period and a discharging period according to the first embodiment.

Referring to FIG. 2, an operation of the control device 2 will be described hereinafter.

In FIG. 2, columns (a) and (b) show command signals which the ECU 3 transmits to the EDU 4. The command signals represent an injection command, a charge command, and a discharge command. Columns (c) and (d) show a piezo current which flows through the piezoelectric elements 21*a*, and a piezo voltage which is applied to the piezoelectric elements 21*a*. In column (c), the piezo current on a plus-side corresponds to charge current, and the piezo current on a minus-side corresponds to discharge current. In column (d), the rising piezo voltage corresponds to charge voltage, and the falling piezo voltage corresponds to discharge voltage.

The ECU 3 computes an injection command time Tq according to a required injection amount and a supply fuel pressure. Then, the ECU 3 outputs the injection command signal according to the computed injection command time Tq. The time period during which the injection command signal is output is divided into a charging period Tc and a holding period Th. During the charging period Tc, the charge command signal is output. During the charging period Tc, the EDU 4 performs a charging control which will be described later. During the holding period Th, the EDU 4 performs a holding control which will be described later. During a discharging period To, the EDU 4 performs a discharging control which will be described later.

Referring to FIG. 2, the charging control will be described hereinafter.

The EDU 4 turns on the charge switch during a period in which the injection command signal is output. Further, the EDU 4 turns on the conduction switch at a time when the injection command signal rises. As shown in columns (c), (d) of FIG. 2, the charge voltage and the charge current start rising. The control device 2 has a circuit which detects the electric charge of the piezoelectric element 21*a*. When an increase in detected electric charge reaches a specified amount, the control device 2 turns OFF the conduction switch. Thereby, the charge current starts falling as shown in the column (c) of FIG. 2. Strictly speaking, even when the conduction switch is turned OFF, the piezo voltage continues to rise. The rising speed of the piezo voltage during OFF of the conduction switch is slower than the rising speed of the piezo voltage during ON of the conduction switch.

When a specified time period has elapsed after the conduction switch is turned OFF, the conduction switch is turned ON again. Until an increase in electric charge reaches a specified amount, the control device 2 is kept ON. As above, the conduction switch is repeatedly turned ON/OFF multiple times, the charge amount of the piezoelectric element 21*a* is increased. The charge amount corresponds to electric energy stored in the piezoelectric element 21*a*, which is proportional to the piezo voltage.

Referring to FIG. 2, the holding control will be described hereinafter.

When the piezo voltage reaches the target voltage Vtrg, the charging control is terminated. The command is changed from the charging period Tc to the holding period Th. During the holding period Th, the control device 2 performs the holding control in which the piezoelectric voltage is held at the target voltage Vtrg. The target voltage Vtrg is established in such a manner that the second valve 32 is not opened. If the target voltage Vtrg is excessively small, a biasing force of the second valve 32 toward the second valve seat 14*b* becomes insufficient. It is likely that the second valve 32 may be opened by the fuel pressure in the nozzle chamber 16. As the supply fuel pressure is higher, the target voltage Vtrg is established higher.

Referring to FIG. 2, the discharging control will be described hereinafter.

When the injection command time Tq has elapsed after a start of energization, the holding period Th shifts to the discharging period To. During the discharging period To, the discharge switch is turned ON. Further, the EDU 4 turns ON the conduction switch at a time when the discharge command signal rises. As shown in columns (c), (d) of FIG. 2, the charge voltage and the charge current start falling. The control device 2 turns OFF the conduction switch when a decrease in detected electric charge reaches a specified amount. Thereby, the charge current starts rising as shown in the column (c) of FIG. 2. Strictly speaking, even when the conduction switch is turned off, the piezo voltage continues to fall. The fall rate of the piezo voltage during OFF of the conduction switch is slower than the fall rate of the piezo voltage during ON of the conduction switch.

The first valve 31 is opened in the charging period Tc. The second valve 32 is closed before the holding period Th. In the discharging period To, the second valve 32 is opened and the first valve 31 is closed. The charge control can be referred to as a valve opening control in which the first valve 31 is opened. Also, the discharge control can be referred to as a valve opening control in which the second valve 32 is opened.

Immediately after the first valve 31 is opened, the fuel in the valve chamber 14 flows out at once to the low-pressure passage 13 as indicated by an arrow in FIG. 4, so that the fuel pressure in the valve chamber 14 drops abruptly. Therefore, immediately after the first valve 31 is opened, the fuel force Fa is abruptly lowered from the fuel force shown in FIG. 3. As a result, the control valve 30 is opened. The rod 28 and the small-diameter piston 26 move closer to the control valve 30. The hydraulic pressure in the oil-tight chamber 24*a* rapidly decreases. The hydraulic pressure in the oil-tight chamber 24*a* exerts a force (extension resistance force) against the driving force of the piezoelectric element 21*a*. Therefore, a sudden decrease in hydraulic pressure in the oil-tight chamber 24*a* causes a sudden decrease in the extension resistance force which is applied to the piezoelectric elements 21*a*.

The piezoelectric element 21*a* is easily damaged by the tensile load. When the extension resistance force is rapidly decreased, a compressive load applied to the piezoelectric elements 21*a* becomes smaller than a compressive preload Fpre, which may cause a damage of the piezoelectric element 21*a*. Such a phenomenon that the compressive load decreases immediately after the valve opening is referred to as "load missing".

As a rising speed of the piezo voltage is higher in the charging control (valve opening control), a valve-opening response of the control valve 30 is more improved, whereby a valve-opening response of the needle 40 is improved. However, as a contrary to this, the load missing described above becomes large and the possibility of damage of the piezoelectric element 21*a* increases.

By providing a pause period Tr in the charging control (valve-opening control) as shown in FIG. 2, the rise speed of the piezo voltage is increased and the valve-opening response is improved, whereby an increase in load missing can be restricted. That is, until a first rising period T1 elapses from a start of charging the piezoelectric element 21*a* in the charging period Tc, the piezoelectric elements 21*a* are charged in such a manner that a rising speed ΔV of the piezo voltage becomes a first speed A1. During the pause period Tr after the first rising period T1, the rising speed ΔV of the piezo voltage is set zero. During a second rising period T2, the rising speed ΔV of the piezo voltage becomes a second speed A2.

The second speed A2 is set to be faster than the first speed A1. According to the present embodiment, a discharging speed "B" in the discharging period To is set to be equal to the first speed A1. The second speed A2 may be equal to the discharging speed "B".

Figure 5:
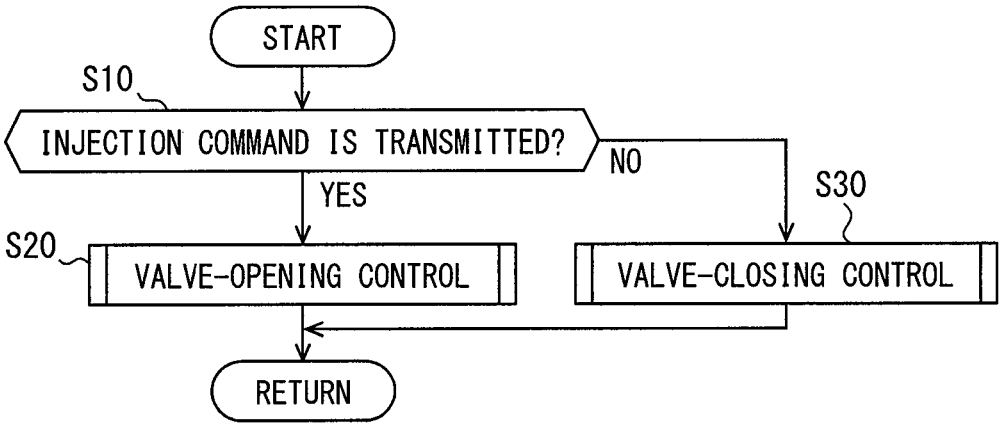
FIG. 5 is a flowchart showing a valve-opening control and a valve-closing control.
Figure 6:
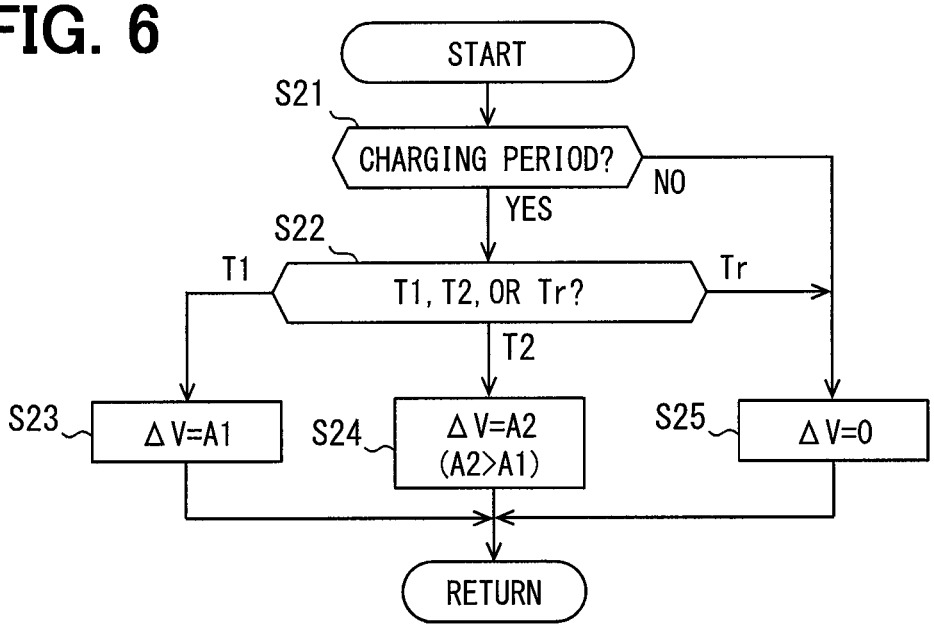
FIG. 6 is a flowchart showing the valve-opening control.
Figure 7:
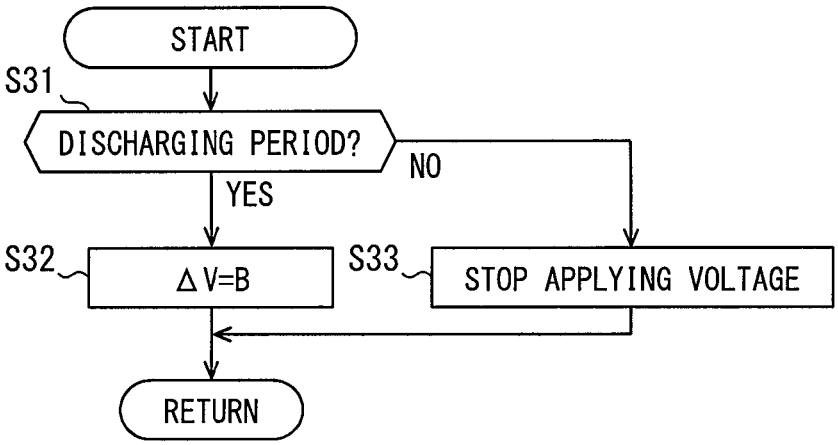
FIG. 7 is a flowchart showing the valve-closing control.

Referring to FIGS. 5 to 7, procedures of the valve opening control and the valve closing control will be described hereinafter.

The process shown in FIG. 5 is repeatedly executed during an operation period of the internal combustion engine. In S10, it is determined whether the ECU 3 is transmitting an injection command signal. When the answer is YES in S10, the procedure proceeds to S20 in which the valve-opening control shown in FIG. 6 is performed. When the answer is NO in S10, the procedure proceeds to S30 in which the valve-closing control shown in FIG. 7 is performed. The injection command signal has a length corresponding to the injection command time Tq, and is transmitted at a timing corresponding to the target injection timing.

In S21 of FIG. 6, it is determined whether it is in the charging period Tc. The charging period Tc starts at the rising edge of the injection command signal and ends at a timing when the piezo voltage reaches the target voltage Vtrg.

When the answer is YES in S21, the procedure proceeds to S22 in which it is determined whether it is in the first rising period T1, the pause period Tr or the second rising period T2. The length of the first rising period T1 is predetermined. The first rising period T1 shifts to the pause period Tr successively. The length of the pause period Tr is predetermined. The pause period Tr shifts to the second rising period T2 successively.

A period immediately before the opening of the first valve 31 is included in the pause period Tr. A valve opening start timing of the first valve 31 is included in the pause period Tr. Specifically, the pause period Tr continues until the piezo current becomes zero.

When it is in the first rising period T1, the procedure proceeds to S23 in which the rising speed ΔV of the piezo voltage is set to the first speed A1. The first speed A1 is a predetermined value. When it is in the second rising period T2, the procedure proceeds to S24 in which the rising speed ΔV of the piezo voltage is set to the second speed A2. The second speed A2 is a predetermined value which is faster than the first speed A 1.

When it is in the pause period Tr, the procedure proceeds to S25 in which the second rising period T2, the procedure proceeds to S24 in which the rising speed ΔV of the piezo voltage is set to zero. When the answer is NO in S21, the procedure proceeds to S25.

In S31 of FIG. 7, it is determined whether it is in the discharging period To. When the answer is YES in S31, the procedure proceeds to S32 in which a falling speed ΔV of the piezo voltage is set to the discharging speed "B". When the answer is NO in S31, the procedure proceeds to S33 in which the piezo voltage becomes zero.

The control device 2 performing S20 corresponds to a "valve opening control portion", and the control device 2 performing S30 corresponds to a "valve closing control portion". The control device 2 performing S23 corresponds to a "first rising control portion", and the control device 2 performing S24 corresponds to a "second rising control portion". Further, the control device 2 performing S25 correspond to a "pause control portion".

Figure 8:
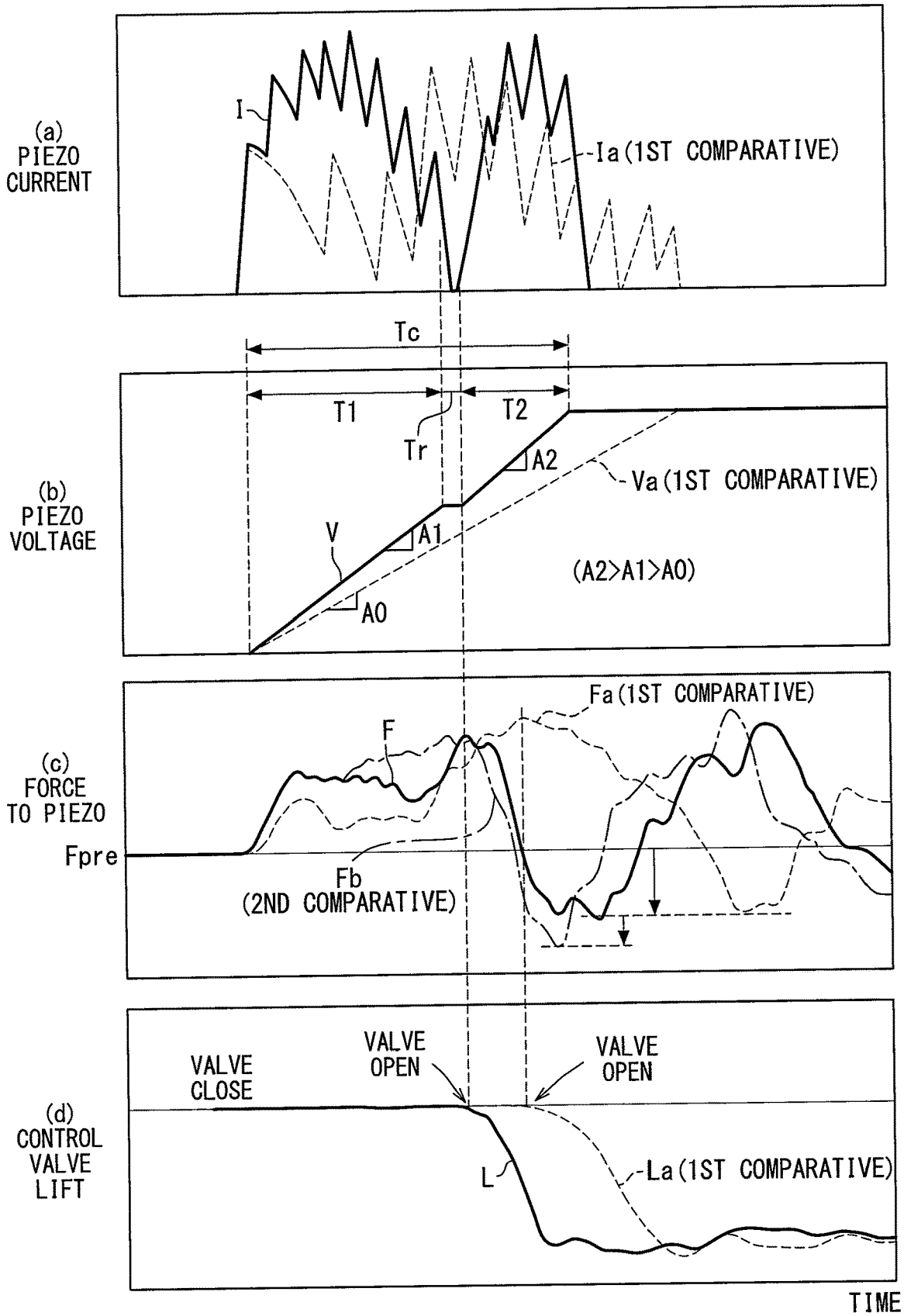
FIG. 8 is a chart showing an experiment result comparing a load missing and valve-closing response with respect to a first embodiment, a first comparative example, and as second comparative example.

FIG. 8 is a timing chart showing a reducing effect of load missing and an improved response of valve-closing response, according to the present embodiment. Also, FIG. 8 shows a first comparative example and the second comparative example. In FIG. 8, solid lines "I", "V", "F" show the present embodiment, dashed lines "la", "Va", "Fa" show the first comparative example. An alternate long and short dashed line "Fb" shows the second comparative example.

Columns (a), (b) of FIG. 8 show the piezo current and the piezo voltage. Column (d) shows a lift amount of the control valve 30. Column (c) of FIG. 8 shows a force (acting force) acting on the piezoelectric elements 21*a*. At a start of charging, the compression preload Fpre is applied to the piezoelectric elements 21*a* as the acting force. When the control valve 30 is opened, the acting force is reduced along with a fuel pressure increase in the valve chamber 14. Then, due to the load missing, the acting force becomes lower than the compression preload Fpre. As the acting force is less decreased immediately after valve opening, the piezoelectric elements 21*a* is less damaged.

As shown in the column (b) of FIG. 8, the first comparative example has no pause period Tr. The rising speed ΔV (=A0) of the piezo voltage is made lower than the first speed A1 and the second speed A2. The rising speed ΔV is a constant value in the first comparative example. Therefore, it takes a long time period until the piezoelectric elements 21*a* are electrically charged for opening the valve. As shown in the column (d) of FIG. 8. a valve opening timing of the control valve 30 is delayed rather than the present embodiment.

The second comparative example has no pause period Tr. The rising speed ΔV of the piezo voltage is set to the first speed A1. The rising speed ΔV is a constant value. The valve opening timing of the control valve 30 is advanced more than the first comparative example. However, as shown by arrows in the column (c) of FIG. 8, the acting force is decreased more than the first comparative example, which may cause a damage of the piezoelectric elements 21*a*.

According to the present embodiment, the pause control is performed immediately before the control valve 30 is opened. An increase in charge amount is temporarily stopped. The decrease in acting force immediately after the valve is opened becomes smaller. That is, even if the rising speed ΔV of the piezo voltage is made higher, it is less likely that the piezoelectric elements 21*a* are damaged. Specifically, the rising speed ΔV of the piezo voltage is made higher than that of the first comparative example, as shown in the column (b) of FIG. 8. The valve opening time of the control valve 30 may be more advanced than that of the first comparative example, as shown in the column (d). However, the decrease in the acting force can be made substantially the same as the first comparative example, as shown in the column (c).

Following findings are obtained from the test results shown in FIG. 8. That is, as the rising speed ΔV is made higher, the load missing is more increased. By temporally stopping the electric charging immediately before the control valve 30 is opened, the load missing can be decreased.

In view of the above, the control device 2 temporarily stops charging of the piezoelectric elements 21*a* before the control valve 30 is opened. Specifically, the control device 2 has the valve opening control portion (S20) that opens the control valve 30 by electrically charging the piezoelectric elements 21*a*, and the valve closing control portion (S30) that closes the control valve 30 by electrically discharging the piezoelectric elements 21*a*. The valve opening control portion includes the first rising control portion (S23), the pause control portion (S25), and a second rising control portion (S24).

The first rising control portion performs the first rising control for increasing the charging amount of the piezoelectric elements 21*a* during the first rising period T1. The pause control portion temporarily stops the first rising control during the pause period Tr after the first rising period T1. The second rising control portion increases the charging amount of the piezoelectric elements 21*a* again during the second rising period T2 after the pause period Tr. The pause period Tr includes a period immediately before the control valve 30 is opened. Immediately after the pause period Tr is started, the control valve 30 is opened.

Therefore, the load missing can be decreased immediately after the control valve 30 is opened, whereby the tensile force acting on the piezoelectric elements 21*a* due to the load missing can be decreased. The rising speed of the piezo voltage can be increased until the pause period Tr is started. The valve opening timing of the control valve can be advanced. Thus, while it is restricted that the piezoelectric elements 21*a* are damaged due to the load missing, the valve-opening response of the first valve 31 can be improved. The valve-opening response of the needle 40 can be improved.

In a case that multiple injections are performed during a combustion cycle, an interval between each injection can be shorted by improving the response of injection start. By shorting the interval, the number of injection can be increased.

According to the present, the pause period Tr includes a valve opening timing of the control valve 30. Based on the fuel pressure, the fuel temperature and the like, a valve opening timing of the control valve 30 is measured. The pause period Tr is set so that the valve opening timing is in the pause period Tr. Therefore, the load missing can be decreased.

The pause control portion holds the charging amount of the piezoelectric elements 21*a* at the constant value. Thus, the piezo voltage can be increased smoothly after the pause period Tr has elapsed.

Furthermore, the pause control portion continues the pause period Tr until the piezo current becomes zero as shown in FIG. 8. Therefore, the load missing can be decreased.

After the control valve 30 is opened, the rising speed of the piezo voltage is increased to reduce the compression preload Fpre as shown in the column (c) of FIG. 8. Thus, the second speed A2 is higher than the first speed A1.

Second Embodiment

Figure 9:
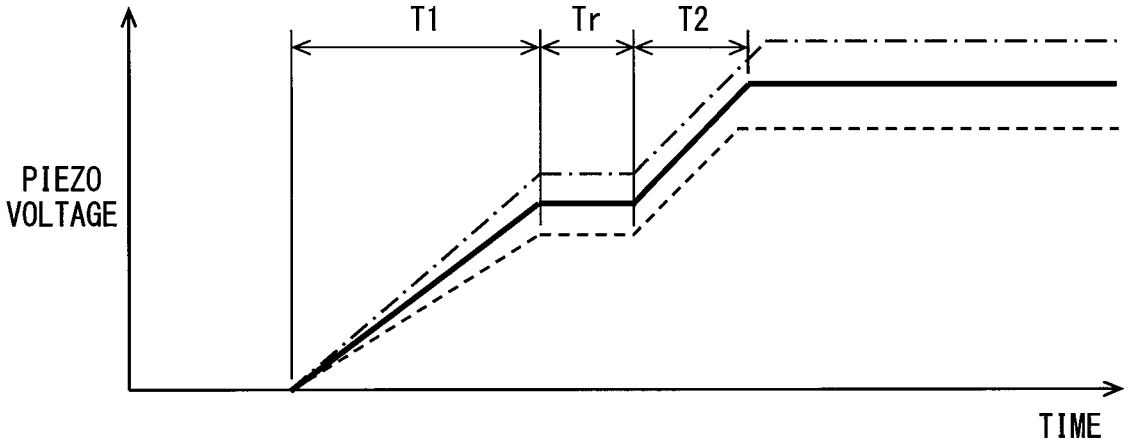
FIG. 9 is a chart showing temporal changes in charging voltage according to a second embodiment.

As shown in FIG. 9, the first speed A1 is variably set according to a supplied fuel pressure. Specifically, as the supplied fuel pressure is higher, the first speed A1 is set higher as shown by an alternate long and short dash line. As the supplied fuel pressure is lower, the first speed A1 is set lower as shown by a dashed line.

A start timing and an end timing of the pause period Tr are fixed without respect to the supplied fuel pressure.

As the supplied fuel pressure is higher, the fuel force Fa becomes larger, so that the charge amount for opening the valve is increased. According to the present embodiment, the first speed A1 is set higher as the supplied fuel pressure is higher. Thus, it is restricted that the valve opening timing of the first valve 31 is delayed due to an increase in the fuel force Fa. When the supplied fuel pressure is low, it can be avoided that the first speed A1 is set excessively large.

Third Embodiment

Figure 10:
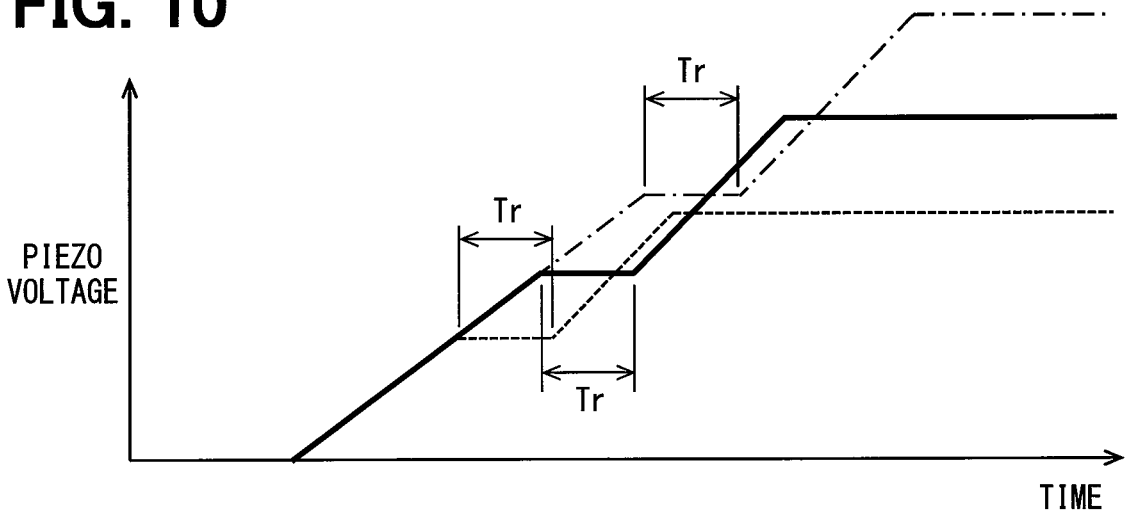
FIG. 10 is a chart showing temporal changes in charging voltage according to a third embodiment.

As shown in FIG. 10, a start timing and an end timing of the pause period Tr are variably set according to a target voltage Vtrg. Specifically, as the supplied fuel pressure is higher, that is, the target voltage Vtrg is larger, the pause period Tr is retarded as shown by an alternate long and short dash line. As the supplied fuel pressure is lower, the pause period Tr is advanced as shown by a dashed line.

Alternatively, one of the start timing and the end timing of the pause period Tr may be variably set according to the supplied fuel pressure.

As the supplied fuel pressure is higher, the maximum voltage applied to the piezoelectric element is set larger and the pause period Tr is more retarded.

Fourth Embodiment

Figure 11:
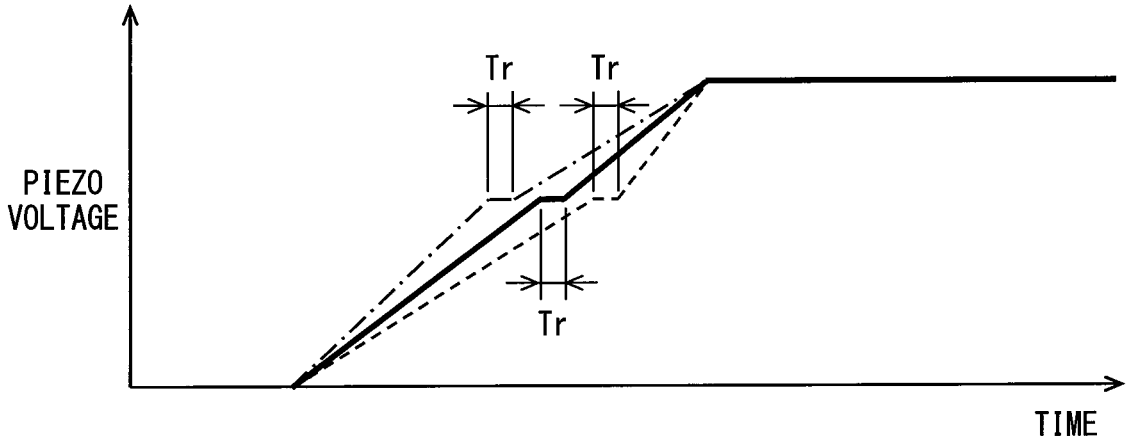
FIG. 11 is a chart showing temporal changes in charging voltage according to a fourth embodiment.

As shown in FIG. 11, the first speed A1 is variably set according to the supplied fuel pressure, and the start timing and the end timing of the pause period Tr are variably set according to the supplied fuel pressure. Specifically, as the supplied fuel pressure is higher, the first speed A1 is set higher and the pause period Tr is advanced as shown by an alternate long and short dash line. As the supplied fuel pressure is lower, the second speed A2 is set lower and the pause period Tr is retarded as shown by a dashed line.

As the supplied fuel pressure is higher, the second speed A2 is set higher.

Other Embodiments

The disclosure is not limited to the above described embodiments.

In the first embodiment, the nozzle chamber 16 and the valve chamber 14 are fluidly connected by the passage which is opened and closed by the second valve 32. However, the passage and the second valve 32 are not always necessary.

In the first embodiment, the charging amount of the piezoelectric elements 21*a* is kept constant during the pause period Tr. However, the charging amount of the piezoelectric elements 21*a* may be decreased during the pause period Tr. For example, the rising speed ΔV of the piezo voltage may be negative so that the piezo voltage is decreased during the pause period Tr.

The pause period Tr may be terminated before the piezo current becomes zero.

In the first embodiment, the pause period Tr includes the valve opening timing of the control valve 30. However, the pause period Tr may be set without including the valve opening timing.

The conduction switch may be turned OFF when an increase in piezo voltage reaches a specified value. Alternatively, the conduction switch may be turned OFF when an increase in piezo current reaches a specified value.

In the second embodiment, as the supplied fuel pressure is higher, the first speed A1 and the second speed A2 may be set smaller. In the third embodiment, as the supplied fuel pressure is higher, the pause period Tr may be more advanced.

The rod 28 may be fixed on the first valve 31. The large-diameter piston 25 may fixed to the abutment plate 23.

What is claimed is:

1. A fuel injection control device which is applied to a fuel injector having:

a valve body opening/closing an injection port through which a fuel is injected;

a control chamber for receiving the fuel which applies a valve-closing force to the valve body;

a control valve controlling the valve-closing force by opening/closing an outlet passage through which the fuel flows out from the control chamber; and a piezoelectric element opening the control valve when being electrically charged to expand;

the fuel injection control device comprising:

a valve opening control portion opening the control valve by electrically charging the piezoelectric element; and a valve closing control portion closing the control valve by electrically discharging the piezoelectric element, wherein the valve opening control portion includes:

a first rising control portion for increasing a charge amount of the piezoelectric element during a first rising period;

a pause control portion for pausing an increase in the charge amount of the piezoelectric element during a pause period after the first rising period;

a second rising control portion for increasing the charge amount of the piezoelectric element during a second rising period after the pause period, wherein the pause period includes a period of immediately before the control valve is opened; and the first rising period, the pause period and the second rising period occur during a single injection cycle.

2. The fuel injection control device according to claim 1, wherein the pause period includes a timing at which the control valve is opened.

3. The fuel injection control device according to claim 1, wherein the pause control portion keeps the charge amount of the piezoelectric element at a constant value.

4. The fuel injection control device according to claim 1, wherein the pause control portion continues the pause period until an electric current flowing through the piezoelectric element becomes zero.

5. The fuel injection control device according to claim 1, wherein a rising speed of the charge amount by the second rising control portion is higher than a rising speed of the charge amount by the first rising control portion.

6. The fuel injection control device according to claim 1, wherein the valve opening control portion increases a maximum voltage applied to the piezoelectric element and retards the pause period as a fuel pressure supplied to the fuel injector is higher.

* * * * *